US005952159A

United States Patent [19]

Wernicke

[11] Patent Number: 5,952,159

[45] Date of Patent: Sep. 14, 1999

[54] METHOD OF PHOTOGRAPHIC PROCESSING

[75] Inventor: Ubbo Wernicke, Rösrath-Kleineichen, Germany

[73] Assignee: Agfa-Gevaert AG, Leverkusen, Germany

[21] Appl. No.: 09/136,815

[22] Filed: Aug. 20, 1998

Related U.S. Application Data

[63] Continuation-in-part of application No. 08/077,318, Jun. 14, 1993, abandoned, which is a continuation of application No. 07/870,818, Apr. 20, 1992, abandoned.

[30] Foreign Application Priority Data

May 4, 1991 [DE] Germany ..... 41 14 599

[51] Int. Cl.[6] ..... G03C 7/30

[52] U.S. Cl. ..... 430/376; 430/401

[58] Field of Search ..... 430/376, 401

[56] References Cited

U.S. PATENT DOCUMENTS

| | | | |
|---|---|---|---|
| 3,372,028 | 3/1968 | Nicastro | 96/4 |
| 3,563,746 | 2/1971 | Ernst et al. | 430/379 |
| 3,607,276 | 9/1971 | Saitama et al. | 430/407 |
| 3,833,376 | 9/1974 | Newman et al. | 96/55 |
| 4,720,451 | 1/1988 | Shuto et al. | 430/379 |

OTHER PUBLICATIONS

Photo–Lab Index 1985, Morgan & Morgan, Dobbs Ferry Supplement No. 178, pp. 68–71.

Ullmans Encyklopädie der technischen Chemie, 3. Auflage, 13. Band, Urban & Schwarzenberg, München, Berlin, "Photographie", pp. 657–660, 662,665,666 (1962).

*Primary Examiner*—Hoa Van Le
*Attorney, Agent, or Firm*—Connolly & Hutz

[57] ABSTRACT

A method of processing photographic silver halide materials comprising several processing steps, in which at least two chemical treatment stages are each followed by a washing and drying is distinguished by reduced chemical consumption and a reduction in the formation of waste solution to be disposed of.

12 Claims, No Drawings

METHOD OF PHOTOGRAPHIC PROCESSING

CROSS-REFERENCE TO RELATED APPLICATIONS

This application is a continuation-in-part of U.S. patent application Ser. No. 08/077,318, filed on Jun. 14, 1993, abandoned, which was a continuation of U.S. patent application Ser. No. 07/870,818 filed on Apr. 20, 1992, abandoned.

This invention relates to a method of photographic processing which provides special economical and ecological advantages.

The processing of photographic silver halide materials comprises several chemical treatment stages which may vary according to the material and the process employed. The chemical treatment stages include in particular development, bleaching, fixing, bleach fixing, conditioning and reversal; development including both the production of a silver image and the production of a color image.

The processing of photographic materials is normally carried out in aqueous baths, the material to be processed entering only the first processing bath in the dry state, this bath being normally the development bath.

In all subsequent processing baths, the photographic material carries water or chemical solutions into the bath.

This causes dilution of the working solution. This dilution of the solution must be compensated for by using replenishers of correspondingly higher concentration.

The introduction of water and supply of replenishing solution leads to an increase in volume of the working solutions.

The various working solutions give rise to bath overflows which must be disposed of. For a rational method of this disposal, the continued overflows are subjected to evaporation.

Vacuum evaporation apparatus are available commercially for this purpose. The concentrate sludge resulting from the evaporation is unusable for photographic purposes and must be discharged.

It is an object of this invention to minimize or to avoid the formation of bath overflows and provide an economically and ecologically improved method of processing photographic materials.

This problem is solved by carrying out a washing or stabilization and a drying after at least two chemical treatment stages within the processing of photographic materials.

In cases in which the washing rate is less than 1 liter/$m^2$, it namely may be advisable to add small quantities of complexing, agents such as aminopolycarboxylic acids and/or organic phosphonic acids to the water to prevent precipitation and the deposition of calcium salts or to add commercial biocides, e.g. of the type of isothiazolinones as protection against the growth of microorganisms or to add antioxidants such as sulphite, hydroxylamine or derivatives such as diethylhydroxylamine as protection against discoloration by oxidation products, or to adjust the pH to values of from 3.5 to 9.5 or to add small quantities of wetting agents.

The additions to the washing are preferably carried out at concentrations of from 0.0001 to 0.01 mol/l.

Liquid adhering to the material after washing or stabilization is preferably to a large extent removed by means of squeezing rollers before drying.

The combination according to the invention of washing and drying is carried out in particular after all chemical treatment stages of the photographic process employed.

It follows that the material enters every chemical treatment stage in a substantially dry state.

Drying is preferably carried out by IR radiation, hot air, microwaves or hot rollers or any combination of these methods of drying.

Standardized processes for color photographic materials containing color couplers are altered by the features according to the invention, for example as follows:

| | previously | according to the invention |
|---|---|---|
| RA-4/AP 94 | color development | color development |
| (Minilab) | bleach fixing | washing |
| | washing | bleach fixing |
| | | washing |
| RA-4/AP 94 | color development | color development |
| (Finisher) | stop bath | washing |
| | bleaching | bleaching |
| | fixing | washing |
| | washing | fixing |
| | | washing |
| C41/AP/70 | color development | color development |
| | bleaching | washing |
| | fixing | bleaching |
| | washing | washing |
| | | fixing |
| | | washing |

In the known processes indicated above, drying is only carried out after the final washing where "washing" may be replaced by stabilization; the attendant disadvantages have been mentioned above. In the process according to the invention, drying is carried out after each washing or stabilization.

According to the invention, the quantity of chemicals required for photographic processing is thereby reduced, with the result that the load on the effluent and the pollution of the environment are directly reduced.

The commercial color paper is a color photographic silver halide material which contains always color couplers.

EXAMPLE 1

(Comparison)

A commercial color paper which is a photographic silver halide material that contains color couplers is processed as follows:

| | | |
|---|---|---|
| Developer | 45 | s/33° C. |
| Washing | 22.5 | s/35° C. |
| Bleaching | 45 | s/33° C. |

-continued

| | | |
|---|---|---|
| Washing | 22.5 | s/25° C. |
| Fixing | 45 | s/33° C. |
| Washing 3x | 22.5 | s/25° C. |

The bleaching bath has the following composition:

Ammonium-iron EDTA 50 g/l

Ammonium bromide 100 g/l pH 5.5.

The replenishment rate is 60 ml/m$^2$. The replenisher has twice the concentration of $NH_4Fe$ EDTA and $NH_4Br$. The tank volume is 5 liters.

The composition of the bleaching bath is determined analytically after the processing of 100 m$^2$ of color paper:

$NH_4Br$ 93 g $NH_4Fe$ EDTA 47 g i.e. the dilution of the working solution by the water carried into it is only just compensated for by a replenishment rate of 60 ml/m$^2$ using a replenishing solution having twice the concentration of the working solution. The replenishment rate would have had to be about 64 ml/m$^2$ for maintaining the original concentrations of ammonium bromide and ammonium iron EDTA.

The quantity of bath overflow was found to be 5790 1. The bath overflow has the same chemical composition as the working solution.

EXAMPLE 2

(According to the Invention)

The procedure is the same as in Example 1 but the photographic material is squeezed through rubber rollers after leaving the first washing and is then irradiated for 22 seconds with a 3×400 Watt Ceramic-IR radiator 75 cm in length. Only then is the photographic material introduced into the bleaching bath tank.

The replenishment rate was 60 ml/m$^2$ and the concentration of replenishing solution was not 200% but only 110% of the concentration of the working solution.

The chemical composition of the working solution was again examined analytically after 100 m$^2$ of color paper had been processed:

$NH_4Br$ 96 g $NH_4Fe$ 48.5 g.

The intermediate drying of the material according to the invention thus enabled the concentrations of replenishing solution to be reduced from 200% to less than 110%.

The quantity of bath overflow was found to be 370 ml, i.e. the amount of bleaching bath carried out of the tank by the photographic materials was somewhat less than the replenishment rate of 60 ml/m$^2$. The intermediate drying according to the invention reduced the amount of bath overflow to be disposed of by more than 90%.

EXAMPLE 3

(Comparison)

The procedure is the same as in Example 1 but in this case the fixing bath is included in the experiment.

The fixing bath had the following chemical composition:

Sodium thiosulphate 70 g/l

Potassium sulphite 15 g/l pH 7.0.

The replenishing solution for the fixing bath has twice the chemical concentration.

The replenishment rate is again 60 ml/m$^2$.

The composition of the fixing bath is examined analytically after the processing of 100 m$^2$ of color paper:

Sodium thiosulphate 68 g/l

Potassium sulphite 12 g/l.

The replenishment thus keeps the chemical composition of the working solution virtually constant although the photographic material carries water into the fixing bath. The overflow of fixing bath amounts to 5930 ml.

EXAMPLE 4

(According to the Invention)

The procedure is the same as in the Example 3 but after leaving the washing stage before the fixing bath, the liquid on the photographic material is squeezed off between rubber rollers and the material is passed through a narrow channel 11 cm in width, 40 cm in length and 2 cm in height.

Hot air (about 80° C.) enters the channel from two flat nozzles at the inlet end of the photographic material into the channel. The photographic material runs between these nozzles.

The air velocity in the channel is from 5 to 50 times the feed rate of the photographic material, depending on the desired degree of drying.

The photographic material which has thus undergone the intermediate drying is then substantially dry as it enters the fixing bath.

The replenishment rate is again 60 ml/m$^2$.

The composition of replenishing solution only corresponds to the concentration of the working solution.

The composition of the fixing bath is examined analytically after the processing of 100 m$^2$ of photographic paper:

Sodium thiosulphate 66.5 g

Potassium sulphite 11.3 g.

The quantity of overflow of fixing bath is 480 ml.

The intermediate drying according to the invention approximately halves the quantity of chemicals required (half concentration of replenishing solution).

In addition, the quantity of fixing bath overflow is reduced by about 90%. The 480 ml of residual overflow found results from the fact that the paper still has a very slight residual moisture as it enters and that the quantity of fixing bath carried out by the photographic material does not correspond exactly to the adjusted replenishment rate.

I claim:

1. A method of processing photographic silver halide materials comprising several processing stages, wherein before any of said processing stages said photographic silver halide materials contain color couplers and further wherein after each of at least two chemical treatment stages the material is subjected to washing or stabilization and then drying.

2. A method according to claim 1, wherein the chemical treatment stages are selected from development, bleaching, fixing, bleach fixing, conditioning and reversal.

3. A method according to claim 1, wherein said drying is carried out by using at least one of IR radiation, hot air, microwaves and hot rollers.

4. The method of claim 1, wherein said several processing stages comprise developing and fixing and after said developing and before said fixing said material is washed or stabilized and then dried, and after said fixing and before any other processing step the material is washed or stabilized and then dried.

5. The method of claim 1, wherein said several processing stages comprise developing, bleaching and fixing and after said developing and before said bleaching said material is washed or stabilized and then dried, and after said bleaching and before said fixing said material is washed or stabilized and then dried.

6. A method of processing photographic silver halide materials comprising several processing stages, wherein before any of said processing stages said photographic silver halide materials contain color couplers and further wherein after each of at least two chemical treatment stages the material is subjected to washing or stabilization and then drying before the next chemical treatment stage.

7. The method of claim 6, wherein one of said at least two chemical treatment stages is a developing step and further wherein, after said developing step, said washing or stabilization and then drying occurs before a bleaching step with-out any other chemical treatment steps occurring after the drying and before the bleaching step.

8. The method of claim 6, wherein one of said at least two chemical treatment stages is a bleaching step and further wherein, after said bleaching step, said washing or stabilization and then drying occurs before a fixing step without any other chemical treatment steps occurring after the drying and before the fixing step.

9. The method of claim 6, wherein said at least two chemical treatment stages are a developing step and a bleaching step and further wherein, after said developing step, said washing or stabilization and then drying occurs before said bleaching step without any other chemical treatment steps occurring after the drying and before the bleaching step, and after said bleaching step, said washing or stabilization and then drying occurs before a fixing step without any other chemical treatment steps occurring after the drying and before the fixing step.

10. The method of claim 6, wherein the chemical treatment stages are selected from development, bleaching, fixing, bleach fixing, conditioning and reversal.

11. The method of claim 6, wherein said drying is carried out by using at least one of IR radiation, hot air, microwaves and hot rollers.

12. A method of processing photographic silver halide materials comprising several processing stages, wherein a) before any of said processing stages said photographic silver halide materials contain color couplers;

b) said several processing stages comprise at least two washing or stabilization steps; and c) after every washing or stabilization step and before the next processing step the material is dried.

* * * * *